US011473840B2

(12) United States Patent
Guidali

(10) Patent No.: US 11,473,840 B2
(45) Date of Patent: Oct. 18, 2022

(54) OVEN FOR THE MELTING OF PRECIOUS METALS IN THE JEWELLERY SECTOR

(71) Applicant: ITALIMPIANTI ORAFI S.P.A., Civitella In Val di Chiana (IT)

(72) Inventor: Roberto Guidali, Mozzate (IT)

(73) Assignee: ITALIMPIANTI ORAFI S.P.A., Civitella In Val di Chiana (IT)

( * ) Notice: Subject to any disclaimer, the term of this patent is extended or adjusted under 35 U.S.C. 154(b) by 0 days.

(21) Appl. No.: 16/907,823

(22) Filed: Jun. 22, 2020

(65) Prior Publication Data

US 2020/0400375 A1 Dec. 24, 2020

(30) Foreign Application Priority Data

Jun. 21, 2019 (IT) ..... 102019000009825

(51) Int. Cl.
*F27B 14/06* (2006.01)
*C22B 4/08* (2006.01)
(Continued)

(52) U.S. Cl.
CPC ..... *F27B 14/061* (2013.01); *C22B 4/08* (2013.01); *C22B 9/003* (2013.01);
(Continued)

(58) Field of Classification Search
CPC ..... F27B 14/02; F27B 14/04; F27B 14/06; F27B 14/061; F27B 14/08; F27B 14/0806;
(Continued)

(56) References Cited

U.S. PATENT DOCUMENTS 4,658,404 A * 4/1987 Sick ..... H05B 6/26 373/143
5,271,033 A 12/1993 Bethge et al.
(Continued)

FOREIGN PATENT DOCUMENTS

CN 107478059 A * 12/2017
CN 107478059 A 12/2017
(Continued)

*Primary Examiner* — Hung D Nguyen
(74) *Attorney, Agent, or Firm* — Pearne & Gordon LLP

(57) ABSTRACT

Described is an oven (1) for melting precious and non-precious metals, non-metallic materials such as ashes, organic industrial waste, inorganic material such as ceramics, which are heat-resistant and not, in particular in the jewellery sector, comprising an outer unit (2) forming an inner space (6) and having an inductive thermal unit (3) positioned around the inner space (6); an inner unit (4) positioned in the inner space (6) and having a melting chamber (5) for a metal to be melted and operating in conjunction with the inductive thermal unit (3) in such a way that a heating of the inner unit (4) by the inductive thermal unit (3) causes the melting of the metal in the melting pot (5). In particular, the melting chamber (5) has an opening (11) for loading and unloading the metal. The inner unit (4) is rotatably mounted in a motor-driven fashion on the outer unit (2) about an axis of rotation (Z) suitable for mixing the metal contained in the melting chamber (5). Moreover, the outer unit (2) has rotatable supporting means (21) defining a tilting axis (Y) perpendicular to the axis of rotation (Z) and suitable for unloading liquid metal from the melting chamber (5).

13 Claims, 3 Drawing Sheets

(51) Int. Cl.
*C22B 9/00* (2006.01)
*F27B 14/08* (2006.01)
*F27B 14/14* (2006.01)
*F27D 3/00* (2006.01)

(52) U.S. Cl.
CPC ..... *F27B 14/0806* (2013.01); *F27B 14/14* (2013.01); *F27B 2014/066* (2013.01); *F27B 2014/0868* (2013.01); *F27D 2003/0087* (2013.01)

(58) Field of Classification Search
CPC ..... F27B 14/14; F27B 2014/066; F27B 2014/0818; F27B 2014/0868; C22B 9/003; C22B 4/00; C22B 4/08; H05B 6/24; H05B 6/26; H05B 6/28; H05B 6/36; F27D 2003/0062; F27D 2003/0087
USPC ..... 373/138, 142, 13, 146, 151–158
See application file for complete search history.

(56) References Cited

U.S. PATENT DOCUMENTS 5,343,492 A * 8/1994 Henn ..... F27B 14/061 266/240
2007/0157761 A1 7/2007 Bratina
2013/0044785 A1* 2/2013 Holms ..... F27B 14/04 373/143
2013/0294473 A1* 11/2013 Cho ..... G21F 9/34 373/8

FOREIGN PATENT DOCUMENTS

CN 209310483 U * 8/2019
DE 19927380 A1 12/2000

* cited by examiner

OVEN FOR THE MELTING OF PRECIOUS METALS IN THE JEWELLERY SECTOR

This invention relates to an oven for the melting of precious and non-precious metals, non-metallic materials such as ash, organic industrial waste, inorganic items such as refractory and non-refractory ceramics, in particular in the jewellery sector.

In particular, the invention can be applied in the processing treatments for precious and non-ferrous metals performed in order to obtain products of high quality and purity.

Moreover, by way of a non-limiting example, the invention may be used for recovering precious metals from poor metals, such as industrial waste or the ashes of jewellery manufacturing.

The above-mentioned procedures are used to increase the effectiveness of homogenisation of metal alloys composed of elements having different physical characteristics (alloys of precious and non-precious metals), to increase the effectiveness of the physical separation of compounds which cannot be mixed together in the liquid phase (ashes, industrial organic waste, inorganic materials such as ceramics, heat-resistant and not), to increase the effectiveness of the purification and refining of metals and non-metals by evaporation and/or selective oxidisation of the various components.

The ovens with static and tipping melting pots are amongst the most common systems used for the melting of metals.

These systems comprise a static melting pot in which the material to be treated is placed and melted.

In particular, in the case of melting ash, organic industrial waste, inorganic materials such as ceramics, which are heat resistant and not, the different phases are separated thanks to the acceleration of gravity which tends to cause the materials with a greater density to be deposited on the bottom of the melting pot.

Disadvantageously, ovens with static melting pots, making use only of gravitational acceleration for separating the various phases, do not allow the metals to be effectively extracted, such as gold or silver, from the melting salts, for example sodium tetraborate.

The materials are extracted by making them flow out from a loading and unloading opening of the melting pot following a tipping of the melting pot itself.

The ovens with static and tipping melting pots can heat the melting pot using gas as an energy source or by electromagnetic induction.

In particular, the electromagnetic induction ovens have operating temperatures lower than gas ovens.

Another problem with static melting pot systems is that this type of device is not able to guarantee an effective mixing of liquid metallic alloys. They do not therefore allow the production of homogeneous alloys with components having different densities.

Moreover, disadvantageously these systems require a manual mixing after the introduction of the various materials inside the melting pot.

In light of the above-mentioned problems, gas systems have been developed which have a rotary melting pot which can be tipped.

This technology, created specifically for the industrial sector for processing copper and nickel, has acquired a leading role in the sector of processing and recovery of precious metals.

In particular, these systems have a melting pot which can rotate about its own mixing axis to promote the separation of the various phases of the materials present in the melting pot by the combined action of the centrifugal force and the force of gravity.

In addition, these systems comprise a tipping axis which facilitates the operations for loading or emptying the melting pot.

However, the gas systems with rotary melting pots have particularly long preheating and melting times.

Moreover, the use of gas results in significant emissions of carbon dioxide which have a negative impact on the ecosystem, increasing the presence of greenhouse gases in the atmosphere, and require greater safety checks.

The technical purpose of the invention is to provide an oven for melting precious metals in the jewellery sector and not only that it is able to overcome the drawbacks of the prior art.

Another aim of the oven for the melting of precious metals, according to the invention, is to improve the efficiency of the process for processing the metals.

In particular, another aim of the invention is to provide an oven for melting precious metals in the jewellery sector which is able to guarantee a high level of uniformity of the products obtained.

The technical purpose indicated and the aims specified are substantially achieved by an oven for melting precious metals in the jewellery sector comprising the technical features described in one or more of the appended claims.

Further features and advantages of this invention are more apparent in the detailed description below, with reference to a preferred, non-restricting, embodiment of an oven for melting precious metals in the jewellery sector, as illustrated in the accompanying drawings, in which.

Figure 1:
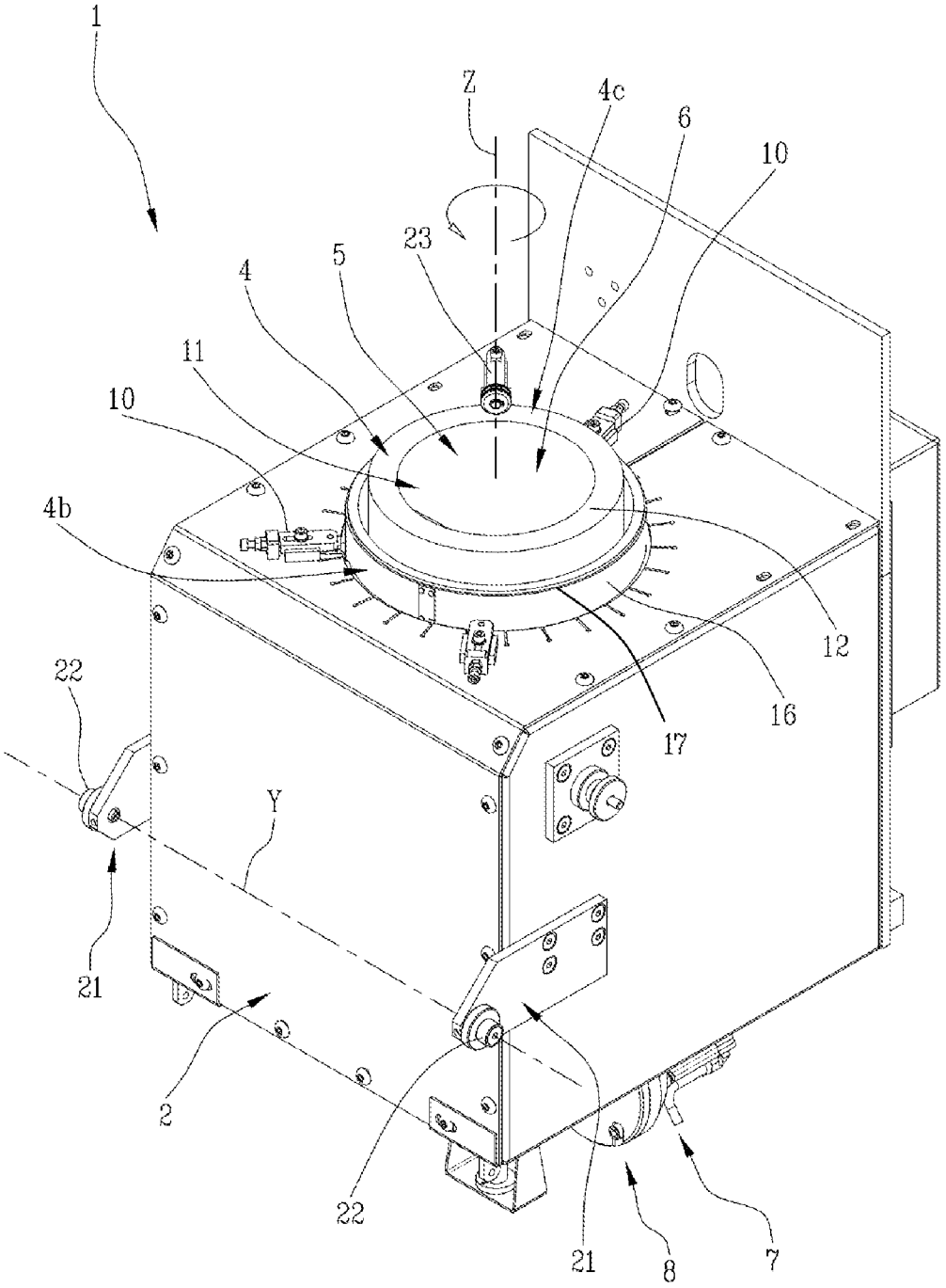
FIG. 1 is a perspective view of an oven for melting precious metals in the jewellery sector according to the invention.
Figure 2:
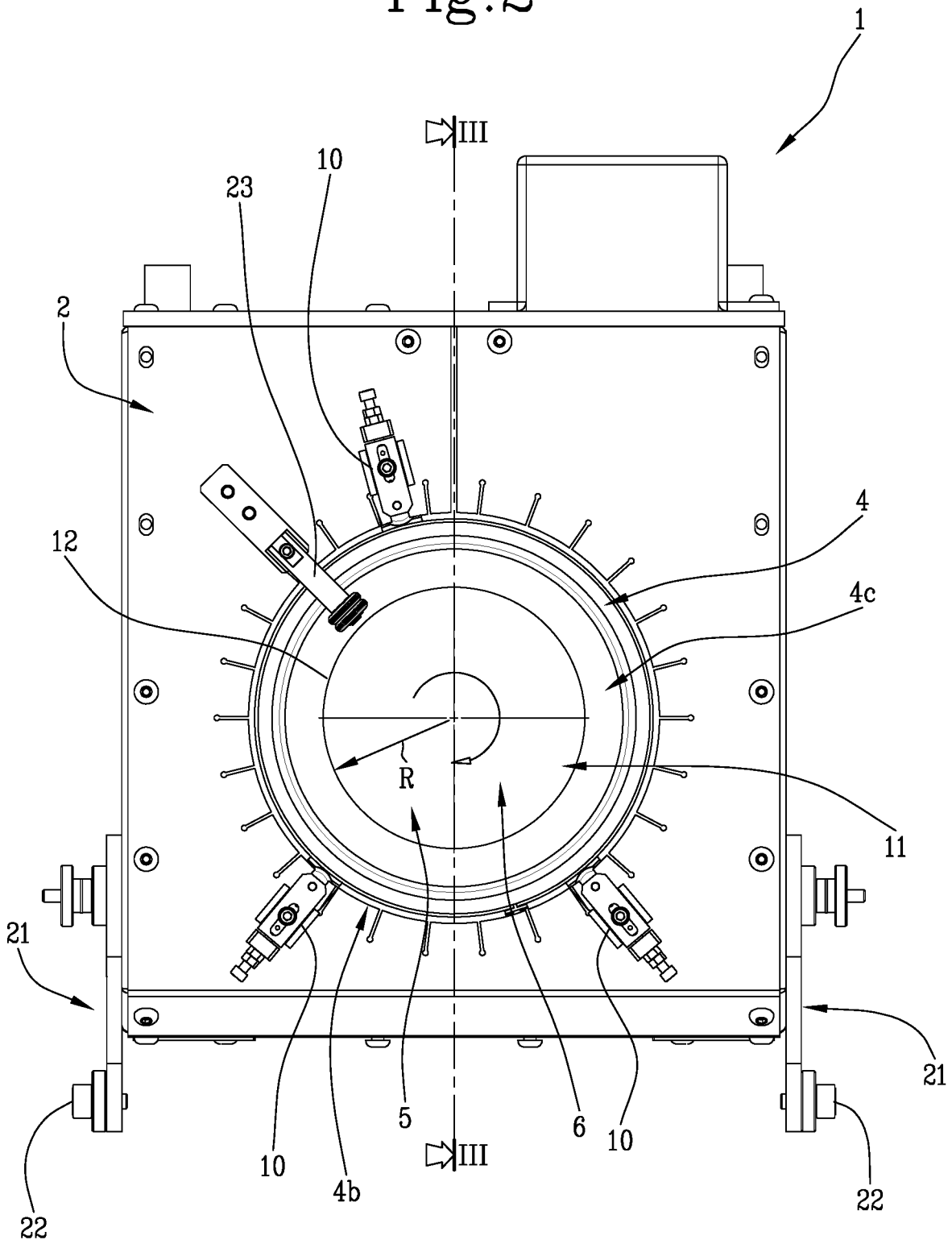
FIG. 2 is a top view of the oven for melting precious metals in the jewellery sector of FIG. 1.

With reference to the accompanying drawings, the numeral 1 denotes in its entirety an oven for melting precious metals in the jewellery sector, which will hereinafter be referred to as oven 1.

The oven 1 has an outer unit 2 comprising an inductive thermal unit 3 and an inner unit 4 having a melting chamber 5 for a metal to be melted.

In particular, the outer unit 2 defines an inner space 6 designed to house the inner unit 4.

In other words, the oven 1 comprises an inner unit 4 positioned inside the inner space 6 and having a melting chamber 5 for a metal to be melted.

According to a possible embodiment and as illustrated in the accompanying drawings, the outer unit 2 has a box shape and defines an inner space 6, preferably cylindrical, designed to rotatably house the inner unit 4.

According to other embodiments not illustrated in the accompanying drawings, the outer unit may differ in shape from the one illustrated, for example cylindrical, without altering the inventive concept which forms the basis of the invention.

The outer unit 2 comprises an inductive thermal unit 3 positioned around the inner space 6.

The inductive thermal unit 3 generates an electromagnetic field which, interacting with the inner unit 4, causes an increase in the temperature of the melting chamber 5 for melting the metal.

In other words, the inner unit 4 acts in conjunction with the inductive thermal unit 3 in such a way that a heating of the inner unit 4 by the inductive thermal unit 3 determines the melting of the metal in the melting chamber 5.

Preferably, the inductive thermal unit 3 comprises a coil "3*a*" positioned around the inner space 6.

According to other embodiments not illustrated in the accompanying drawings, the inductive thermal unit 3 may comprise magnets suitably arranged to generate an electromagnetic field having features similar to those of the field generated by the coil "3*a*" without altering the inventive concept which forms the basis of the invention.

Advantageously, the outer unit 2 has rotation means 7 acting on the inner unit 4 to set it in rotation relative to the outer unit 2 about an axis of rotation "Z" in such a way as to promote an effective mixing of the molten metal inside the melting chamber 5.

In particular, the inner unit 4 is rotatably mounted in a motor-driven fashion on the outer unit 2 about an axis of rotation "Z" suitable for mixing the metal contained in the melting chamber 5.

In this way, the oven 1 guarantees high levels of uniformity of the metal obtained allowing a particularly efficient removal of the impurities.

Preferably, the rotation means 7 allow the inner unit 4 to rotate relative to the outer unit 2 at an angular speed of approximately 1-2 revolutions per minute up to a maximum of 20 revolutions per minute.

According to a possible embodiment, the rotation means 7 comprise a stepping electric motor 8.

In particular, the rotation means 7 may comprise an electric motor whose axis is perpendicular to the axis of rotation "Z" and connected to a mechanical transmission at right angles, preferably a worm transmission.

According to a possible embodiment and as illustrated in the accompanying drawings, the rotation means 7 are mounted in a suspended fashion on a lower surface of the outer unit 2.

The rotation means 7 comprise a rotatable rotation shaft 9 connected to the inner unit 4 for rotating it relative to the outer unit 2.

According to a possible embodiment, the rotation shaft 9 can house a sensor "S" for measuring the temperature connected to the melting chamber 5 and designed to send a signal representing the temperature of the melting chamber 5 to an external control unit (not illustrated in the accompanying drawings).

According to other possible embodiments, the sensor "S" may find a different location or not be present without altering the inventive concept which forms the basis of the invention.

Advantageously, the oven 1 can also comprise a plurality of guide rollers 10, made preferably of ceramic material, mounted on the outer unit 2 and engaged in a rolling fashion on an outer cylindrical surface "4*b*" of the inner unit 4 close to a respective loading/unloading opening 11.

In other words, the inner unit 4 can rotate relative to the outer unit 2 and the plurality of guide rollers 10 is active on the inner unit 4 guiding it during the rotation.

As illustrated in the accompanying drawings, the inner unit 4 may comprise a melting pot 12 delimiting the melting chamber 5 and defining the opening 11 for loading and unloading the metal.

Figure 3:
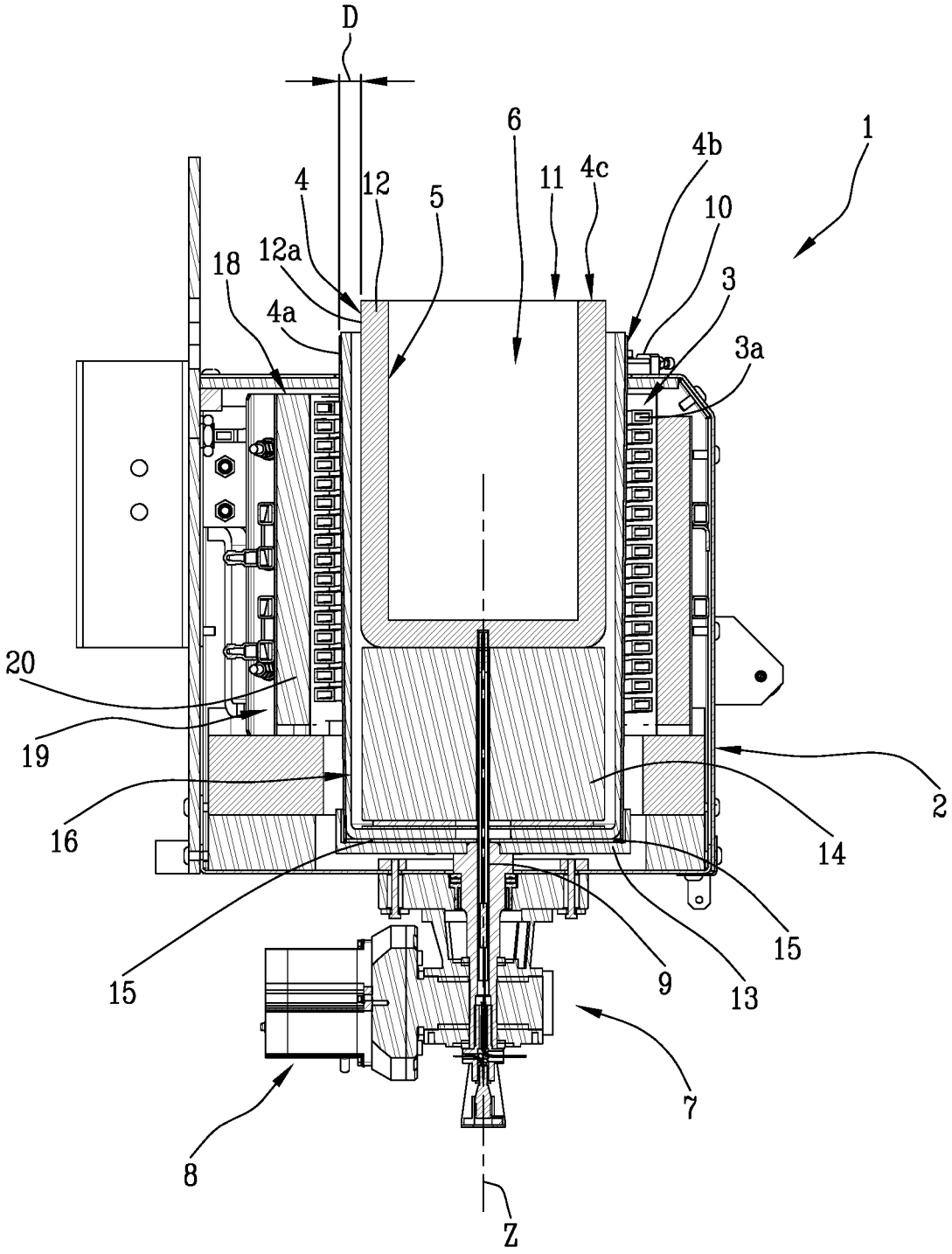
FIG. 3 is the cross-section III-Ill of the oven for melting precious metals in the jewellery sector of FIG. 2.

With reference to FIG. 3, the inner unit 4 has an outer lateral surface "4*a*", preferably cylindrical, having a distance "D" from a corresponding inner lateral surface "12*a*" of the melting pot 12 of substantially between 15 and 25 mm and preferably equal to approximately 20 mm.

The minimum distance "D" guarantees a particularly effective electromagnetic interaction between the outer unit 2 and the inner unit 4 and limits the possibility that the high temperatures of the melting chamber 5 can damage the outer unit 2: if the melting pot 12 were too close to the inductor 3 the oven 1 would have losses, whilst if, vice versa, the inductor 3 were too far the magnetic field would not have the correct effectiveness. In particular, the gap defined by the outer lateral surface "4*a*" and by the inner lateral surface "2*a*" may contain air.

Preferably, the loading and unloading opening 11 defines a circular opening of radius "R" designed to allow the metal to be effectively introduced and extracted.

In particular, the bottom of the inner unit 4 has a cup-shaped portion 13 rotatably integral with the rotary rotation shaft 9 and supporting the melting pot 12 by interposing a heat insulating spacer 14 preferably ceramic.

The cup-shaped portion 13 is made of a metallic material, for example stainless steel, preferably stainless steel or other diamagnetic metals or suitable materials such as ceramic or heat-resistant.

The melting pot 12 is made at least partly of a material suitable for induction heating by the inductive thermal unit 3.

In particular, the melting pot 12 is rotatably integral with the rotation shaft 9 rotatable about the axis of rotation "Z".

Advantageously, the inner unit 4 also comprises an outer containment body 16 made of a thermally insulating material, preferably a heat-resistant material, in such a way as to thermally isolate the melting pot 12 from the inductive thermal unit 3.

The outer containment body 16 has a substantially cup-shaped extension and contains at least partly the melting pot 12.

Advantageously, the inner unit 4 may comprise a plurality of thermally insulating elements 15, preferably ceramic, interposed between the body 16 and the melting pot 12 designed to limit the thermal dispersion between the inner unit 4 and an outside environment.

In particular, the succession of heat-resistant spacers 15 acts as a joint between the substantially horizontal portions of the body 16 and jacket of the melting pot 12.

Advantageously, the inner unit 4 may also comprise a covering sheath 17 positioned outside the outer containment body 16.

The covering sheath 17 gives mechanical strength and toughness to the inner unit 4 contributing to overcoming the problems relating to the intrinsic fragility of the heat-resistant material generally used for making the outer containment body 16.

Still more advantageously, the covering sheath 17 may have a cup shape in such a way as to contain the molten metal in the case of failures or breakages of the outer containment body 16.

In the embodiment described here, the covering sheath 17 is a titanium screen of approximately two millimetres, designed to give solidity.

Preferably, the covering sheath 17, if it is conductive, has a longitudinal slot (not illustrated in the accompanying drawings) designed to limit an electromagnetic interaction between the covering sheath 17 and the inductive thermal unit 3.

In a variant embodiment, the sheath 17 is made of heat-resistant ceramic material transparent to the electromagnetic field. These heat-resistant materials have high mechanical properties (for example, silico-aluminous alloys or boron nitride).

Moreover, the sheath 17 is preferably cemented with the melting pot 12, using materials susceptible to induction (silicon carbide or graphite).

Preferably, there may be ceramic reinforcement inserts designed to connect the flaps of the above-mentioned slot so as to guarantee the mechanical seal of the covering sheath 17.

In this way, the sheath 17 guarantees an increase in the mechanical properties of the outer containment body 16 limiting the interactions with the magnetic field generated by the inductive thermal unit 3.

Advantageously, the outer unit 2 may also comprise electromagnetic insulation means 18 designed to limit an electromagnetic interaction between the inductive thermal unit 3 and an outside environment.

The electromagnetic insulation means 18 limit the radiation induced by the inductive thermal unit 3 on the surrounding environment, thus increasing the safety for personnel using the oven 1.

Preferably, the electromagnetic insulation means 18 comprise a Faraday cage 19 and/or a layer made of diamagnetic material 20, for example copper sheet extending on the perimeter of the inductive thermal unit 3.

Moreover, the oven 1 may comprise a liquid cooling system designed to limit the temperatures induced by the melting chamber 5 on the outer unit 2 and on the surrounding environment.

The diamagnetic plates 20 use, on the one hand, the cooling system of the inductor 3 and, on the other hand—close to the Faraday cage 19—they have pipes through which a cooling fluid flows (not illustrated).

Advantageously, the invention guarantees that the operations for loading and unloading the metal are performed thanks to the possibility of moving the oven 1 relative to a tilting axis "Y".

In particular, the outer unit 2 may have rotatable supporting means 21 defining the tilting axis "Y" suitable for unloading the liquid metal from the melting chamber 5.

Preferably, the tilting axis "Y" is perpendicular to the axis of rotation "Z".

In other words, the rotatable supporting means 21 allow the outer unit 2 to be rotated to facilitate the operations for loading and unloading the metal through the opening 11 for loading and unloading the melting chamber 5.

The rotatable supporting means 21 may allow a rotation of the outer unit 2 by an angle which is necessarily greater than 90°, preferably between 0 vertical degrees and 180 vertical degrees opposite, even more preferably 135 degrees.

As illustrated in the accompanying drawings, the rotatable supporting means 21 may comprise the rotation pins 22 positioned opposite each other relative to the inner unit 4 and defining the tilting axis "Y".

Moreover, the oven 1 may also comprise a stationary casing (not illustrated in the accompanying drawings) having two supports which can be coupled to the rotatable supporting means 21, preferably a pair of guides for the rotation pins 22, of the outer unit 2 to define the tilting axis "Y".

In particular, the casing may have tipping means acting on the outer unit 2 for tilting the outer unit 2 about the tilting axis "Y".

Advantageously, the oven 1 may comprise at least one axial locking roller 23 mounted on the outer unit 2 and engaged in rolling motion on a front annular surface "4*c*" of the inner unit 4 close to the loading and unloading opening 11.

In this way, the axial locking roller 23 allows a rotation of the inner unit 4 relative to the outer unit 2 preventing a relative axial sliding during a rotation of the oven 1 relative to the tilting axis "Y".

Preferably, the axial locking roller 23 is made of ceramic material, for example aluminium, silicon carbide, silicon nitride or boron nitride.

It should be noted, therefore, that the invention achieves the preset aims thanks to an oven for melting precious metals in the jewellery sector comprising an outer unit having an inductive thermal unit and an inner unit, forming a melting chamber, rotatably mounted in a motor-driven fashion on the outer unit for mixing the metal contained in the melting chamber.

Advantageously, the rotation means guarantee a high level of uniformity of the metal obtained following the melting and allow an efficient removal of the impurities present in the unprocessed material.

Advantageously, moreover, the oven may be used both in batch mode and continuously.

Advantageously, the sensor inside the rotation shaft makes it possible to control the temperature on the inner surface of the melting pot with high reliability.

Moreover, the particular shape of the inner and outer units simplifies the replacement of the melting pot compared with the common gas systems.

Advantageously, the outer containment body made of heat-resistant material reduces the thermal dispersions, guaranteeing a high energy efficiency.

The invention claimed is:

1. An oven (1) for the melting of precious and non-precious metals, non-metallic materials such as ash, organic industrial waste, inorganic items such as refractory and non-refractory ceramics, in particular in the jewellery sector, comprising:

an outer unit (2) defining an inner space (6) and having an inductive thermal unit (3) positioned around said inner space (6);

an inner unit (4) positioned in said inner space (6) and having a melting chamber (5) for a metal to be subjected to melting and acting in conjunction with said inductive thermal unit (3) in such a way that a heating of the inner unit (4) by said inductive thermal unit (3) determines the melting of the metal in said melting chamber (5), said melting chamber (5) having an opening (11) for loading and unloading the metal;

wherein said inner unit (4) is rotatably mounted in a motor-driven fashion on the outer unit (2) about an axis of rotation (Z) suitable for mixing the metal contained in the melting chamber (5); and wherein the outer unit (2) has rotatable supporting means (21) defining a tilting axis (Y) perpendicular to said axis of rotation (Z) and suitable for unloading liquid metal from the melting chamber (5);

the outer unit (2) comprising electromagnetic insulation means (18) designed to limit an electromagnetic interaction between the inductive thermal unit (3) and an outside environment, said electromagnetic insulation means comprising a layer made of diamagnetic material (20) extending outside said inductive thermal unit (3), characterised in that the oven (1) comprises a plurality of guide rollers (10), mounted on the outer unit (2) and engaged in a rolling fashion on an outer cylindrical surface (4*b*) of the inner unit (4) close to said loading/unloading opening (11).

2. The oven according to claim 1, wherein said outer unit (2) has rotation means (7) acting on the inner unit (4) for rotating the inner unit (4) about said axis of rotation (Z).

3. The oven according to claim 2, wherein said rotation means (7) are suspended in a suspended fashion on a lower surface of said outer unit (2).

4. The oven according to claim 2, wherein said rotation means (7) comprises an electric motor (8).

5. The oven according to claim 1, wherein said inner unit (4) comprises a melting pot (12) delimiting said melting chamber (5) and said loading/unloading opening (11), said melting pot (12) being made at least partly of a material suitable for induction heating by said inductive thermal unit (3); said melting pot (12) being rotatably integral with a rotation shaft (8) rotatable about said axis of rotation (Z).

6. The oven according to claim 5, wherein said inner unit (4) also comprises an outer containment body (16) made of a thermally insulating material.

7. The oven according to claim 6, wherein said inner unit (4) also comprises a covering sheath (17) positioned outside the outer containment body (16), said covering sheath (17) having a longitudinal slot designed to limit an electromagnetic interaction between said covering sheath (17) and said inductive thermal unit (3).

8. The oven according to claim 7, wherein said covering sheath (17) is made of titanium.

9. The oven according to claim 7, wherein said covering sheath (17) is made from heat-resistant ceramic materials transparent to the electromagnetic field, said covering sheath (17) being cemented with said melting pot (12).

10. The oven according to claim 6, wherein said outer containment body (16) is made of refractory material, designed to thermally insulate said melting pot (12) from said inductive thermal unit (3).

11. The oven according to claim 1, comprising at least one axial locking roller (23), mounted on the outer unit (2) and engaged in a rolling fashion on a front annular surface of the inner unit (4) close to said loading/unloading opening (11).

12. The oven according to claim 11, wherein said at least one axial locking roller (23) is made of ceramic material.

13. The oven according to claim 1, wherein said plurality of guide rollers (10) are made of ceramic material.

* * * * *